United States Patent [19]

Slawny

[11] 4,131,271

[45] Dec. 26, 1978

[54] METHOD AND APPARATUS FOR INTERFOLDING

[75] Inventor: Howard J. Slawny, Green Bay, Wis.

[73] Assignee: Paper Converting Machine Company, Green Bay, Wis.

[21] Appl. No.: 806,107

[22] Filed: Jun. 13, 1977

[51] Int. Cl.[2] ..... B41L 1/30
[52] U.S. Cl. ..... 270/40
[58] Field of Search ..... 270/40

[56] References Cited

U.S. PATENT DOCUMENTS 3,401,928 9/1968 Frick ..... 270/40

*Primary Examiner*—Edgar S. Burr
*Assistant Examiner*—A. Heinz
*Attorney, Agent, or Firm*—Tilton, Fallon, Lungmus & Chestnut

[57] ABSTRACT

A method and apparatus for interfolding featuring a series of identical folding plates each with six folding edges for use in V or Z interfolding.

1 Claim, 8 Drawing Figures

METHOD AND APPARATUS FOR INTERFOLDING

BACKGROUND AND SUMMARY OF INVENTION

This invention relates to a method and apparatus for interfolding and, more particularly to the interfolding of lightweight webs at high speed and in an efficiently used space. This invention is an improvement upon Shirasaka Application Ser. No. 666,224, filed Mar. 11, 1976, now U.S. Pat. No. 4,052,048.

In the above-identified application, a novel structure and method was provided utilizing identical folding plates for the longitudinal interfolding of one-half lapped webs, i.e., for V folding. Previously, V folding had been achieved longitudinally but with much longer machines because right and left hand folding plates were employed — making the machines almost twice as long.

In contrast to the V folding which had been performed in longitudinal fashion previously, Z folding has been performed commercially in transverse fashion. Although rotary machines for transverse folding can operate at substantial speeds, they operate on but a single web and therefore are much less efficient than longitudinal folding where literally hundreds of webs are processed simultaneously. Z folding is particularly advantageous — as for packaged toweling — because a much longer length of towel can be dispensed (as from a wall dispenser) without increasing the depth of projection from the wall. For example in contrast with V interfolded towels, the Z folded (for the same depth of dispenser) yields a towel sheet 50% longer. Thus, many users of hand towels prefer the Z folded version.

In light of the demand for more efficient Z folding equipment, it was decided to attempt to Z fold using folding plates made according to the above identified Shirasaka application. The Z folding was achieved by the folding plates but some difficulty was encountered in thread-up, i.e., advancing a Z folded web from an "upstream" folding plate toward and underneath the next downstream folding plate. To ease the thread-up procedure, I remove the tongue which projects forwardly from the side of the folding device creating the overfold. This not only resulted in a satisfactory Z fold but one considerably easier to thread and further functions equally well for V folding.

Thus, I have provided an even simpler folding plate than that of the above identified application but which possesses undiminished the space and adjustability advantages thereof but even further facilitates threadup. With all of these advantages, it was surprising to me that they were not appreciated previously in a structure somewhat similar as set forth in U.S. Pat. No. 3,679,095. There, however, the folding plate was used for what might be termed a "partial" Z fold and this only for the top layer of a stack of V folded tissue webs.

DETAILED DESCRIPTION

The invention is described in conjunction with the accompanying drawing, in which FIG. 1 is a perspective schematic view of apparatus embodying teachings of this invention;

Figure 1:
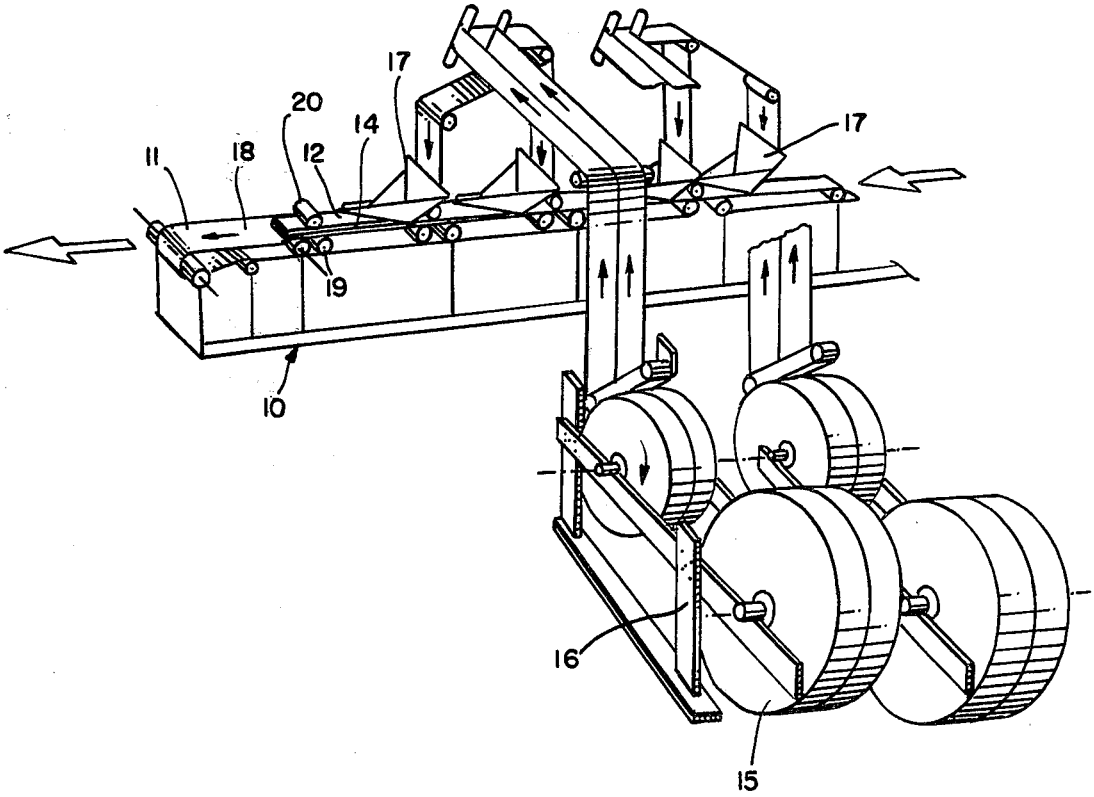

In the illustration given and with reference first to FIG. 1, the numeral 10 designates generally a frame for interfolding. Mounted on the frame is an endless belt 11 which defines a horizontal path of travel for webs being interfolded. The webs, adjacent the discharge end of the apparatus are seen to form a stack 12. A partial stack 12' can be seen in the lower left hand portion of FIG. 2 where the sides or edges of the stack lie in vertical, marginal planes 13 and 14. In other words, the longitudinally extending vertical marginal planes 13 and 14 define the sides of the path of travel of the webs.

Referring again to FIG. 1, the webs are provided from a plurality of parent rolls 15 each of which is mounted on an unwind stand 16. The unwind stands advantageously are provided on one side of the path so as to reduce space requirements for the apparatus. The parent rolls 15 are unwound (usually by suitable driven unwind mechanisms) and conducted to folding plates generally designated 17 and which can be better appreciated from a consideration of FIGS. 2 and 3. More particularly, the frame 10 supports a plurality of longitudinally spaced apart, identical folding plates in the path of travel of the webs making up the stack 12.

Referring again to FIG. 1, it will be noted that the belt 11 has an upper run which supports and advances the various webs. The upper run 18 is seen to be supported between each of the adjacent folding plates by rolls 19 which are resiliently urged upwardly against confining rolls 20. Thus, as the stack 12 increases in thickness, the upper run 18 of the belt 11 can move downwardly so as to accommodate the increased thickness. Inasmuch as the upper or confining rolls 20 are horizontally aligned with the folding plate 17, a folded web issuing from an upstream plate is aligned with and urged against the underside of the next downstream folding plate. As will be brought out hereinafter, the novel structure of the folding plates of the instant invention make threadup a simple matter of merely pulling a given folded web past the next downstream folding plate for contact with the next successive confining roll 20 whereupon the upward action in combination with the action of the next succeeding web being folded brings about an automatic interfolding. This is particularly beneficial in avoiding the need for the tongue and the threading throat specified in the above-identified Shirasaka application. However, many other of the details of the instant invention are found in the above identified Shirasaka application and reference may be made thereto for additional information on the details.

Figure 2:
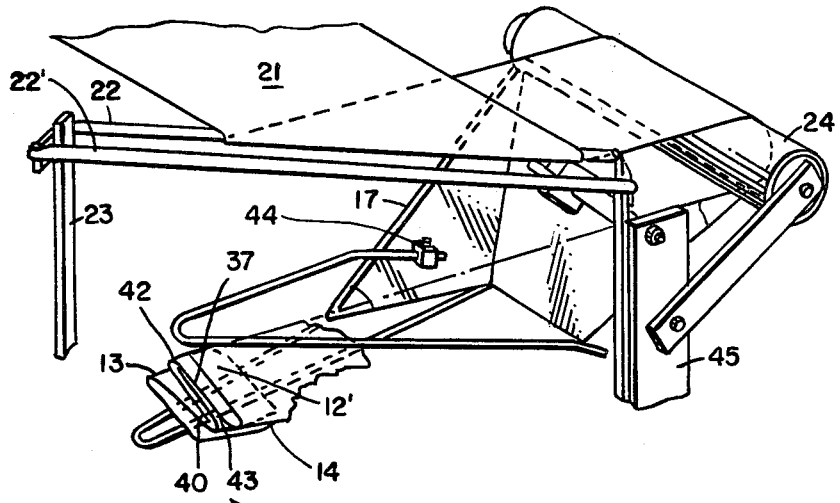
FIG. 2 is a fragmentary perspective view of one of the folding plates of the instant invention showing web material in the process of being Z interfolded.

The instant invention is illustrated in conjunction with an embodiment relating to Z interfolding and will first be discussed with reference to FIG. 2. In FIG. 2, a web in the process of being first folded and thereafter interfolded is designated in the upper left hand portion of the view by the numeral 21. In contrast to V folding, Z folding requires that a given folding plate 17 handle only a single web. Thus, the direction of web 21 is changed by means of a single turning bar 22 suitably supported by posts 23 provided as part of the frame 10. A second turning bar 22' is provided on the posts 23 in the event the apparatus is to be used for V folding. In such a case, a second web, one-half overlapped relative to the first web 21 is partially wrapped around the bar 22' in accordance with the teaching of the above identified Shirasaka application. The turning bars in the schematic showing of FIG. 1 are spaced differently to avoid obscuring the folding plate arrangement. However, as in the other views, the arrangement in FIG. 1 is set up for Z folding.

The web 21 is then directed around a turning roll 24 (see the right hand side of FIG. 2) and is Z folded to form the arrangement depicted at the lower left hand corner of FIG. 2.

Figure 3:
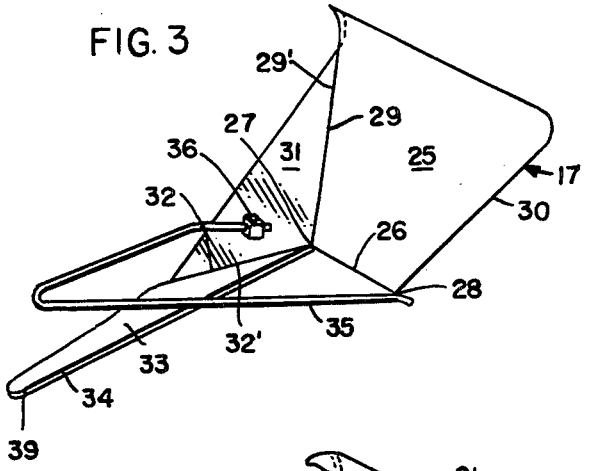
FIG. 3 is a perspective view of the folding plate of FIG. 2 but without any web material associated therewith.

To explain in somewhat greater yet simpler detail, the progress of a web around the folding plate 17 is depicted in FIGS. 4–8. The essential components of the folding plate 17 are seen in FIG. 3. There the folding plate is seen to include a first planar part 25 which has a generally trapezoidal shape providing a horizontal folding edge 26 which extends transversely across the path of travel of a web being folded. The first folding edge 26 has first and second end points 27 and 28 which are respectively in the first and second vertical marginal planes 13 and 14. The first planar part 25 additionally provides second and third folding edges 29 and 30 which extend respectively from the first and second marginal end points 27 and 28. The second and third folding edges 29 and 30 extend upwardly and rearwardly relative to the web path of travel and are seen to be upwardly divergent relative to each other, thus providing the generally trapezpidal shape mentioned above.

The folding plate 17 includes a second planar part 31 having a generally triangular shape to provide a fourth folding edge 32 which extends forwardly in the path from the first margin end point 27 and lies in the first marginal plane 13. The second planar part 31 additionally provides a connecting edge 29' which connects the second planar part 31 to the first planar part 29 along the second folding edge 29.

The folding plate 17 additionally includes a third planar part 33 which also has a generally triangular shape and which provides a fifth folding edge 34. The folding edge 34 extends from the margin end point 31 diagonally relative to the path of travel of web material and across the path to terminate in the second margin 14. This can be readily appreciated from the lower left hand portion of FIG. 2. The third planar part 33 also provides a connecting edge 32' connected to the fourth folding edge 32 of the second planar part 31. In essence, the second planar part 31 can be considered a gusset connecting the first and third planar parts 25 and 33.

The apparatus also includes a sixth folding edge 35 (here illustrated as a rod secured at one end as at 36 to the second planar part 31). The important portion of the folding edge 35 extends diagonally across the path of travel from a point slightly above the margin end point 28 (sufficient to permit the web to pass therebetween) and forwardly to the vertical marginal plane 13. The intersection of the sixth folding edge 35 with the vertical marginal plane 13 is a spaced distance rearward of the intersection of the fifth folding edge 34 with the vertical marginal plane 14.

OPERATION

Figure 4:
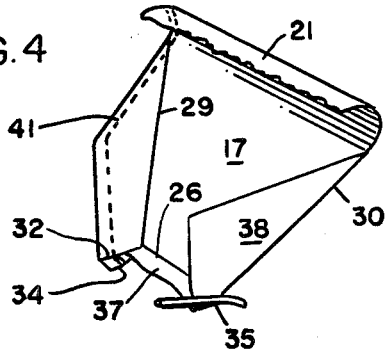
FIG. 4 is a fragmentary perspective view of a portion of the folding plate of FIG. 3 and showing web material in an initial phase of being folded.

Referring now to FIG. 4, a fragment of the web 21 is seen in the process of being wrapped around the initial or upstream portion of the folding plate 17. It will be noted that a Z fold is being developed by having the middle portion 37 of the fold pass under the first folding edge 26 so that the edges of the middle portion 37 are defined or created by the marginal end points 27 and 28.

The upper portion of the Z fold is in the process of being created by turning the portion 38 around the folding edge 30 and thereafter reversely around the sixth folding edge 35. More particularly, the actual fold line between the portions 37 and 38 is developed by the web engaging the marginal end point 28.

The lower portion of the Z fold is in the process of being created by turning a portion of the web first around the second folding edge 29, then around the fourth folding edge 32 and ultimately around the fifth folding edge 34.

Figure 6:
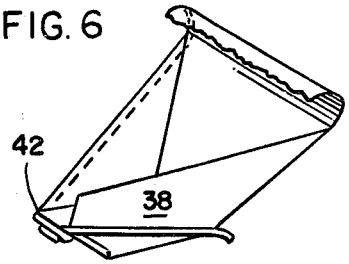
FIGS. 5–8 are views similar to FIG. 4 but showing the web material in subsequent stages of folding.
Figure 7:
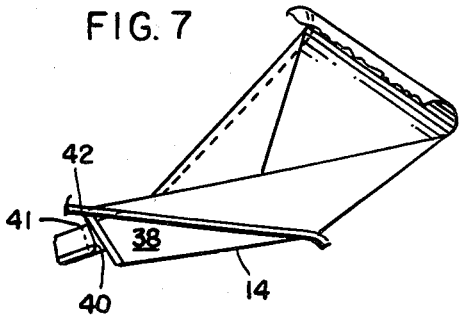
Figure 5:
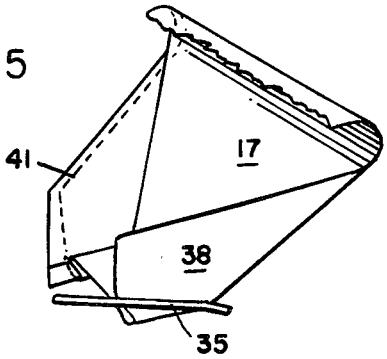

FIG. 5 represents, in effect, a section taken through the folding plate 17 a short distance downstream of the section through the folding plate and web seen in FIG. 4. In FIG. 5, substantially more of the upper portion 38 has been folded under the sixth folding edge 35 and by the time the section corresponding to FIG. 7 is taken, the upper portion 38 is completely folded. In FIG. 6, the upper portion 38 of the Z fold is about halfway folded.

Figure 8:
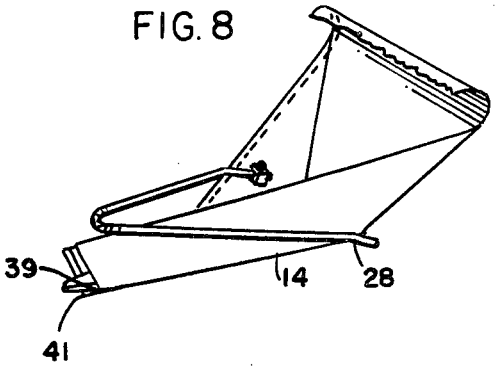

In FIG. 8, it will be seen that the margin 14 is defined by the second marginal end point 28 and the end 39 of the third planar part 33. In contrast to the Shirasaka folding plate, I have found that there does not have to be a folding edge in the marginal plane 14 — only the points 28 and 39.

The lower portion 40 of the Z folded web (see for example, FIGS. 2 and 7) is developed by turning around three folding edges, i.e., the second folding edge 29, the fourth folding edge 32 and the fifth folding edge 34. Comparison of FIGS. 4–8 shows that the web margin 41 which eventually arrives at the margin 14 in FIG. 8 is turning under the third planar portion 33 to create a rolling action defining a pocket 42 which induces the top portion of a preceding Z folded web to enter into interfolded relation with the web 21 in the process of being folded.

Significantly facilitating this operation is the fact that there is a triangular open bottom to each folding device 17 — defined by the first folding edge 26, the fifth folding edge 34, and the vertical marginal plane 14. Thus, a substantial area of contact is provided between the upper layer 43 of a previously folded web and the middle portion 37 of a web being folded (see the lower left hand portion of FIG. 2). The portion 43 of the preceding web is urged upwardly and into the pocket 42 by the rolling movement of the lower portion 40 of the web being formed.

It will be appreciated that the sixth folding edge 35 has an operational length extending essentially from slightly above the second marginal end point 28 to the vertical marginal plane 13. Thus, it can be mounted in a number of ways. For example, in the illustration given, it is conveniently mounted on the second planar part 36 by means of a clamp block 44. Alternatively, the end of the folding edge 35 adjacent the second marginal end point 28 can be extended for securement to the post 45 (see FIG. 2) which supports the folding plate 17 — the post 45 being part of the frame 10.

I claim:

1. A method of sequentially folding elongated webs into Z-type configurations to achieve a continuous stack of interfolded webs comprising (A) pulling first web material along a linear path of travel having longitudinally extending first and second vertical marginal planes (13, 14) and through the first of a series of horizontal spaced apart folding devices (17) in said path, each folding device consisting essentially of:

(i) a first planar part (25) having a generally trapezoidal shape providng a horizontal folding edge (26) extending transversely across said path and having first and second end points (27, 28) respectively in said first and second vertical marginal planes, said trapezoidal shape providing second and third folding edges (29, 30) extending respectively from said first and second margin end points upwardly and rearwardly relative to said path of travel and being upwardly divergent relative to each other, (ii) a second planar part (31) having a generally triangular shape to provide a fourth folding edge (32) extending forwardly in said path from said first margin end point (27) and in said first vertical marginal plane (13), and a connecting edge (29') connected to said first planar part (25) along said second folding edge (29), and (iii) a third planar part (33) also having a generally triangular shape and having a fifth folding edge (34) extending from said first margin end point (27) diagonally forwardly relative to said path and across said path to terminate in said second vertical marginal plane (14), and a connecting edge (32') connected to the fourth folding edge (32) of said second part (31), (iv) said apparatus also including a sixth folding edge (35) connected at at least one end (36) thereof to one of said frame and its associated folding plate and extending diagonally across said path from a point slightly above said second margin end point (14) forwardly to said first vertical marginal plane (13), said sixth folding edge (35) being located above said fifth folding edge (34) and intersecting said first vertical marginal plane (13) a spaced distance rearwardly of the intersection of said fifth folding edge (34) with said second vertical marginal plane (14) whereby each folding plate has a triangular open bottom defined by said first (26) and fifth (34) folding edges and said second vertical marginal plane (14), whereby said web material develops three longitudinally extending portions:

(a) a constant width middle portion (37) passing under said horizontal folding edge (26) and over said third planar part (33), (b) a gradually widening upper portion (38) passing around said third folding edge (30) and under said sixth folding edge (35), and (c) a gradually widening lower portion (40) passing around said second folding edge (29), over said second planar part (31), around said folding edge (32) and rolling around said fifth folding edge (34), (B) pulling second web material through the next device in said series while pulling the now Z-folded first web material under said next device and positioning the upper portion (38) of said first web material in contact simultaneously with the gradually widening lower portion (40) of the second web material and the constant width middle portion (37) thereof to cause said first web material upper portion (38) to enter between said second web material lower and middle portions (40, 37), and (C) repeating the above sequence for each successive folding device.

* * * * *